United States Patent [19]

Heynisch et al.

[11] 3,970,891

[45] July 20, 1976

[54] ELECTRON COLLECTOR FOR AN ELECTRON BEAM TUBE

[75] Inventors: Hinrich Heynisch, Graefelfing; Paul Meyerer, Ottobrunn; Roland Wolfram, Munich, all of Germany

[73] Assignee: Siemens Aktiengesellschaft, Berlin & Munich, Germany

[22] Filed: Jan. 30, 1975

[21] Appl. No.: 545,377

[30] Foreign Application Priority Data

Mar. 1, 1974 Germany ..... 2409869

[52] U.S. Cl. ..... 315/3.5; 313/41; 313/44; 315/3.6; 315/5.38

[51] Int. Cl.[2] ..... H01J 25/34

[58] Field of Search ..... 315/3.5, 3.6, 5.38; 313/41, 44

[56] References Cited

UNITED STATES PATENTS

| | | | |
|---|---|---|---|
| 2,398,582 | 4/1946 | Dinnick et al. | 313/41 |
| 2,753,482 | 7/1956 | Dorgelo | 315/5.38 |
| 3,104,338 | 9/1963 | Symons | 315/5.38 |
| 3,260,885 | 7/1966 | Crapuchettes | 315/5.38 |
| 3,549,930 | 12/1970 | Katz | 315/5.38 |

*Primary Examiner*—Saxfield Chatmon, Jr.
*Attorney, Agent, or Firm*—Hill, Gross, Simpson, Van Santen, Steadman, Chiara & Simpson

[57] ABSTRACT

An electron collector for an electron beam tube, in particular a high performance transit time tube, employs a hollow member for receiving the electrons, which hollow member is surrounded by a metallic cooling sleeve which is grounded during operation of the tube and which is electrically insulated therefrom for an operating potential which deviates from the ground potential. The collector is particularly characterized in that it comprises a highly heat resistant material with a low vapor pressure (melting point at least approximately 2,000°C) and apart from an insulating attachment in the area of its electron beam entry opening extends by forming a vacuum space completely free standing into the cooling sleeve. The cooling sleeve is blackened at its inner surface facing the collector and is permeated during operation by a coolant supplied from a forced cooling system.

11 Claims, 2 Drawing Figures

ELECTRON COLLECTOR FOR AN ELECTRON BEAM TUBE

BACKGROUND OF THE INVENTION

1. Field of the Invention

This invention relates to an electron collector for an electron beam tube, in particular a high performance transit tube, comprising a hollow collector member for receiving the beam electrons, which is surrounded by a metallic cooling sleeve that is grounded during operation of the tube and which is insulated from the same electrically for an operating potential which differs from the ground potential.

2. Description of the Prior Art

In a collector which is biased with respect to ground, for example a so-called "depressed collector" in transit time tubes, it is important that the collector be electrically insulated from its surrounding cooling sleeve in such a way that the loss connected therewith in respect of heat diffusion remains as low as possible. Generally, ceramic distance spacers are used as heat conducting insulating paths. For example, a ceramic sleeve may be soldered with the collector and the cooling sleeve as an insulator, as set forth in U.S. Pat. No. 3,471,739. Due to the different heat expansion coefficients of the soldered parts, however, during the heating of the tube thermal displacements occur during operation which can lead to the formation of cracks in the solder, and even to the breaking of the ceramic. Consequently, an apart from the fact that the ceramic is already only as adequate a heat conductor as it is an electrical insulator, during the course of time unpredictable breaks in the heat transport capacity and locally very high temperature gradients occur which considerably reduce the performance and durability of the tube.

In order to meet such difficulties, it has been attempted to stack ceramic rings in a metal ceramic compound one after the other as a distance element between collector and sleeve metal ribs, whereby the ribs contact alternately either only the sleeve or only the collector. This type of structure is disclosed in U.S. Pat. No. 3,662,212. As a parallel hereto, a way has been found to support distance elements in recesses of the collector as well as the sleeve wall impressed thereon. This type of structure is disclosed in U.S. Pat. No. 3,679,929. All of these suggestions, however, require increased production efforts and costs, and do not lead to a long term satisfactory discharge condition.

SUMMARY OF THE INVENTION

The primary object of the invention is to provide a collector structure which avoids the aforementioned shortcomings.

In order to realize this object, in particular for the creation of a collector with reliable safely insulated collectors which are protected from inadmissable overheating, it is provided that in an electron collector of the initially-mentioned type, that the collector comprise a highly heat resistant material having a low vapor pressure (a melting point at least approximately 2000°C) and, apart from an insulating attachment in the area of its electron beam input opening, extends completely unsupported into the cooling sleeve by forming a vacuum chamber. The cooling sleeve is blackened at its inner surface which faces the collector and is permeated during operation of the tube by a coolant which is supplied by a forced cooling system.

In an electron collector, the vacuum surrounding the collector constitutes a highly effective insulator which allows a completely unhindered heat discharge. Thereby, the blackened cooling sleeve inner surface provides the metallic sleeve with a high absorportion capacity for all frequencies of the heat wave spectrum. Furthermore, the forced cooling provides that the direct surrounding of the collector, and therefore a corresponding tube, is only subjected to slight amounts of heat and that, however, also vice versa different surrounding conditions such as fluctuations in the outer temperature, solar radiation, reflecting walls, do not intolerably interfere with the heat condition of the tube as, for example, an increase in the collector temperatures or effect an anisotropic distribution.

Finally, the mounting of the collector by the self supporting attachment at the collector neck remains largely untouched by the various heat expansions of the collector parts. As a result of the suggested combination of steps, a collector with evenly good insulating and cooling is achieved, whose temperature conditions can be accurately controlled.

The principle of a pure radiation cooling has been well known and proven successful for decades in the field of transmitter tubes, predominantly concentrically constructed performance grid tubes. In addition, various suggestions have become known to utilize this heat transmission possibility for linear beam tubes when using satellites, as disclosed in U.S. Pat. No. 3,448,325 and German Pat. No. 1,541,967. In the case of a klystron having a depressed collector, according to U.S. Pat. No. 3,448,325, the vacuum sleeve is provided in the area of the collector with a part which is as transparent as possible for wave lengths of the heat spectrum (an infra red window). These contributions, however, have not been successful in later collector construction development, in particular for ground fixed tubes which are exposed to the entire atmospheric pressure. Those skilled in the art have concentrated on the completion of the initially-mentioned collector concept within the framework of conduction cooling. In this respect compare the previously mentioned U.S. Pat. Nos. 3,662,212 and 3,679,929.

It has finally become known from the German published application 1,564,629 to provide a carbon collector with a metallic surrounding inasfar as such a surrounding is required, for example for magnetic shielding. The carbon member is thereby inserted into the surrounding sleeve like a cartridge whose predominant part is a slight distance from the metal sleeve. The heat discharge takes place by means of radiation with the advantage that the carbon member has a balancing effect on the heat dissipation and thus local overheatings of the metal wall are prevented. The arrangement can, however, also be operated as a depressed collector without requirements being stated concerning the electrical insulation. The initially mentioned problems of a favorable heat conducting collector insulation are not dealt with in this case.

An electron collector constructed according to the invention can be provided in a particularly advantageous manner due to its stable temperature conditions with a gas binder like a non-evaporating getter. It is known that absorption getters only bind within certain temperature ranges. For example, a zirconium getter binds between 800°C and 1600°C, while a tantalum getter binds between 700°C and 1200°C. The zirconium getter has the feature that not all interfering gases are absorbed in the same temperature areas. If these ion pumps are heated excessively, their getter capacity is influenced irreversibly (a zirconium getter which is mixed with molybdenum allo forms alloy at 1500°C, while a zirconium carbon getter forms carbide at 1300°C). Because of the high operating temperatures, it would be desirable to apply the getter directly onto the surfaces of the collector which are hot during operation; so far, however, it was necessary because of the temperature conditions at the collector which could not be controlled for an extended period of time to introduce additional electrodes into the tube which could be kept at the various operating temperatures (German Letters Patent 1,539,156).

BRIEF DESCRIPTION OF THE DRAWING

Other objects, features and advantages of the invention, its organization, construction and operation will be best understood from the following detailed description taken in conjunction with the accompanying drawing on which there are two figures which illustrate, in longitudinal cross section, an electron collector for an electron beam tube constructed in accordance with the principles of the present invention.

DESCRIPTION OF THE PREFERRED EMBODIMENT

Figure 1:
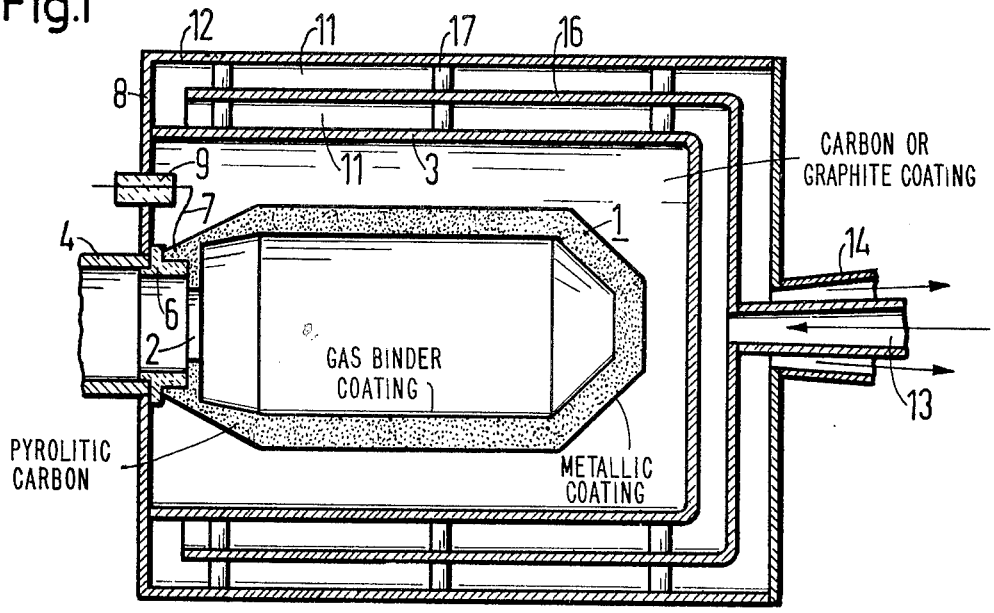
In FIG. 1 the collector comprises one electrode (stage).

Referring to the drawing, an elevational section of a tube is illustrated at the collector side. The electron collector comprises a hollow member (collector) 1 having an electron beam entry opening 2 and a cylindrical cooling sleeve 3 which surround the collector 1 without contacting the same. Only the portion of the tube sleeve which precedes the collector 1 is illustrated and is provided with the reference character 4.

The tubular parts including the tube sleeve 4, the cooling sleeve 3 and the collector 1 are soldered together by way of a ring-shaped insulating piece 6 in such a way that the collector 1 is supported in a self-supporting manner and does not require any further supporting means.

The delay structure (not illustrated) of the traveling wave tube is connected, like the cooling sleeve 3, to ground potential, the potential of the collector however being lower. Such a depressed collector improves the entire efficiency of the tube due to decreased self heating. It receives its bias voltage by way of a feed line 7 which is guided through a frontal wall 8 of the cooling sleeve 3 through a guide 9.

In the illustrated embodiment, the collector 1 comprises carbon. The carbon is thereby obtained pyrolitically in order to give it a predetermined direction of heat conductance. This predetermined direction extends in the side wall of the collector 1 radially to the collector longitudinal axis so that the solder points at the insulating part 4 and the rest of the tube are kept relatively cool. For a further shielding of the mentioned solder points from the heat loss arising predominantly at the collector bottom, the wall strength of the collector grows thinner toward the electron beam entry opening 2.

The cooling sleeve 3 is blackened on its inner side; for example, the cooling sleeve inner surface may be painted with a graphite suspension or also coated with carbon. Its side wall is provided with longitudinal channels 11, flow directing sheets 16 and sheet supports 17 and, like the back wall, is surrounded with a covering plate 12. An inlet stud 13 and an outlet stud 14 in the covering plate 12 provide that the cooling sleeve 3 can be connected to a circulating pump and can thus be permeated as a part of a forced cooling system by cooling fluid. Such heat exchangers with a counter current principle are actually known per se and for details in this respect one may refer to literature, such as for example U.S. Pat. No. 3,104,338.

The inner wall of the collector 1 is coated in certain areas with a fetter-capable, non-evaporating layer of a zirconium carbide mixture.

Figure 2:
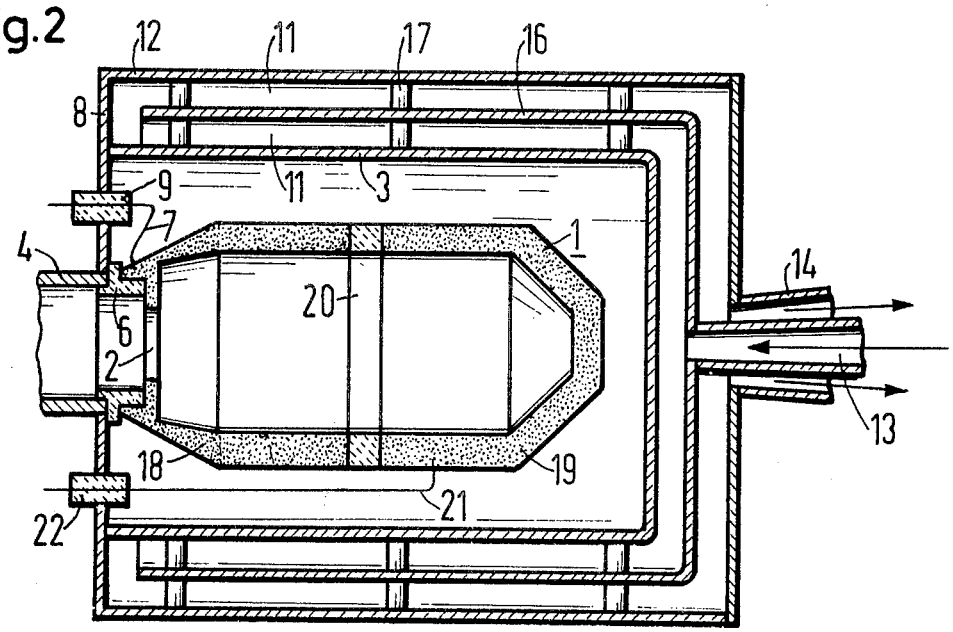
In FIG. 2 the collector comprises two electrodes (stages).

In FIG. 2, the collector 1 comprises two electrodes (stage 18 and 19) instead of one electrode. Both stages are electrically insulated from each other by an insulating ring 20. Stage 19 receives its bias voltage by way of a feed line (second feed line 21), which is guided through the front wall 8 through a guide (second guide 22).

As an alternative, the collector could also comprise a highly melting metal, such as for example molybdenum or tungsten. Also, additional heat brakes in front of the insulation part 2 are possible, for example vacon rings in the collector member or reflecting screens consisting of tantalum, etc. The collector area around the electron beam entry opening can be kept particularly cool if the collector consists of several electrodes which are connected with each other via insulating rings and are located one after the other in the electron beam direction and have a different bias voltage (a multi-stage collector), since here already the electrode dividing insulating rings act as narrow passes for the axial heat flow on the collector. Instead of a getter layer, the ion collector can also be designed in the form of a thorn extending from the collector floor into the hollow space and having a cathode-like potential, whereby this thorn can consist, for example, of molybdenum. Finally, it is also possible to fill the vacuum between the collector and the sleeve with an inert gas. In this case, however, the space of the discharge chamber of the tube has to be separated in a vacuum-tight manner and in case of a carbon collector the collector wall has to be provided with a metal layer or also a metal interim layer.

Although we have described our invention by reference to particular illustrative embodiments thereof, many changes and modifications of the invention may become apparent to those skilled in the art without departing from the spirit and scope of the invention. We therefore intend to include within the patent warranted hereon al such changes and modifications as may reasonably and properly be included within the scope of our contribution to the art.

We claim:

1. An electron collector structure for an electron beam tube, comprising: a hollow member for receiving the beam electrons a metallic cooling sleeve surrounding said hollow member and connected to ground, said hollow member electrically insulated from said cooling sleeve for operation at a potential which is different from ground, said hollow member comprising a highly heat resistant material having a low vapor pressure, means mounting said hollow member in a free standing condition within said cooling sleeve, a black coating on the inner surface of said cooling sleeve facing said hollow member, and said cooling sleeve adapted for connection to a forced cooling system to receiving a flow of coolant therethrough.

2. An electron collector structure according to claim 1, wherein said highly heat resistant material has a melting point of at least approximately 2000°C.

3. An electron collector structure according to claim 1, comprising a gas binder carried on said hollow member.

4. An electron collector structure according to claim 1, wherein said hollow member consist of carbon.

5. An electron collector structure according to claim 4, wherein said hollow member has a radially extending preferred direction of heat conductance at least in its side wall area.

6. An electron collector structure according to claim 1, wherein said hollow member includes a collector wall and a metallic layer carried by said collector wall.

7. An electron collector structure according to claim 1, wherein said hollow member includes an end wall having electron beam input opening therein and is cantilever mounted in the area of said opening, and includes a tapered side wall of decreasing thickness approaching said opening.

8. An electron collector structure according to claim 1, wherein said hollow member comprises a plurality of electrodes for connection to different operating potentials.

9. An electron collector structure comprising:

a hollow cooling sleeve including a first end, a second end, a serpentine coolant passageway, a coolant inlet, a coolant outlet coaxial with said coolant inlet in said first end and in communication with said passageway, and an opening in said second end;

a hollow electron collector including an open end and a closed end and disposed within said cooling sleeve, said collector comprising a highly heat resistant material with a low vapor pressure; and means mounting said collector as a cantilever with its open end in communication with the opening in said second end of said cooling sleeve and its closed end facing said first end of said cooling sleeve.

10. An electron collector structure according to claim 3, wherein said hollow member consists of carbon.

11. An electron collector structure according to claim 1, wherein said hollow member includes an end wall having electron beam input opening therein and is attached by an insulating attachment in the area of said electron beam input opening.

* * * * *